US008851021B2

(12) United States Patent
Kim et al.

(10) Patent No.: US 8,851,021 B2
(45) Date of Patent: Oct. 7, 2014

(54) METHOD FOR CONTROLLING HOT WATER TEMPERATURE THROUGH OPERATION OF A CIRCULATION PUMP

(75) Inventors: Si-Hwan Kim, Incheon (KR); Yongmin Song, Gyeonggi-do (KR)

(73) Assignee: Kyungdong One Corporation, Seoul (KR)

( * ) Notice: Subject to any disclaimer, the term of this patent is extended or adjusted under 35 U.S.C. 154(b) by 318 days.

(21) Appl. No.: 13/392,916

(22) PCT Filed: Oct. 21, 2010

(86) PCT No.: PCT/KR2010/007236

§ 371 (c)(1), (2), (4) Date: Feb. 28, 2012

(87) PCT Pub. No.: WO2012/053679

PCT Pub. Date: Apr. 26, 2012

(65) Prior Publication Data

US 2012/0216998 A1 Aug. 30, 2012

(51) Int. Cl.

*F24D 3/02* (2006.01)
*F24D 17/00* (2006.01)
*F24D 19/10* (2006.01)

(52) U.S. Cl.

CPC ..... *F24D 17/0078* (2013.01); *F24D 19/1051* (2013.01); *F24D 2220/0207* (2013.01)
USPC ..... 122/14.3; 237/8 C

(58) Field of Classification Search

CPC ..... F24H 1/00; F24H 7/04; F24D 3/02; F24D 19/10
USPC ..... 122/14.1, 14.3, 14.21; 237/8 A, 8 C, 237/12.3 B, 59, 62; 137/563
See application file for complete search history.

(56) References Cited

U.S. PATENT DOCUMENTS 4,347,972 A * 9/1982 Hillerstrom et al. ..... 236/18
5,205,318 A * 4/1993 Massaro et al. ..... 137/337

(Continued)

FOREIGN PATENT DOCUMENTS

DE 101 18 250 A1 1/2002
EP 1 342 957 A1 9/2003

(Continued)

OTHER PUBLICATIONS

Supplementary European Search Report mailed on Apr. 4, 2013.

(Continued)

*Primary Examiner* — Gregory A Wilson
(74) *Attorney, Agent, or Firm* — Hershkovitz & Associates, PLLC; Abraham Hershkovitz

(57) ABSTRACT

A method for controlling the temperature of hot water through an operation of a circulation pump according to the present invention includes: judging whether a user uses the hot water; judging whether one of the circulation pump operating modes is selected; and circulating the hot water in an outflow pipe to an inflow pipe by operating the circulation pump provided on a bypass pipe connecting the inflow pipe which direct water enters and the outflow pipe through which heated hot water flows out to each other when the user uses the hot water and selects one of the circulation pump operating modes, thereby controlling a temperature difference of the hot water that flows out from a water heater to be reduced.

5 Claims, 7 Drawing Sheets

(56) References Cited

U.S. PATENT DOCUMENTS

| | | | | |
|---|---|---|---|---|
| 8,528,503 | B2 * | 9/2013 | Deacon et al. | 122/1 C |
| 2009/0211644 | A1 * | 8/2009 | Wylie et al. | 137/2 |
| 2010/0212604 | A1 | 8/2010 | Kim | |
| 2010/0326646 | A1 | 12/2010 | Kim | |
| 2011/0132279 | A1 * | 6/2011 | Le Mer | 122/14.3 |
| 2013/0019858 | A1 * | 1/2013 | Wieland | 126/585 |

FOREIGN PATENT DOCUMENTS

| | | | |
|---|---|---|---|
| JP | 2001-317748 | A | 11/2001 |
| JP | 2002-228167 | A | 8/2002 |
| JP | 2003-056853 | A | 2/2003 |
| JP | 2005-016748 | A | 1/2005 |
| KR | 10-0279885 | B1 | 7/2000 |
| KR | 10-2003-0026604 | A | 4/2003 |
| KR | 10-2004-0106651 | A | 12/2004 |
| KR | 10-2011-0032748 | A | 3/2011 |
| SU | 1241029 | A1 | 6/1986 |
| WO | WO 2008/140184 | A1 | 11/2008 |
| WO | WO 2009/157630 | A1 | 12/2009 |

OTHER PUBLICATIONS

English language Abstract for SU 1241029 A1.
Russian Decision to Grant a Patent issued in a counterpart foreign patent application on May 28, 2013.
English Language Abstract of JP 2005-016748 A.
English language translation of the Japanese Office Action dated Oct. 2, 2012.
English Language Abstract of JP 2001-317748 A.
English Language Abstract of JP 2002-228167 A.
English Language Abstract of JP 2003-056853 A.
English Language Abstract of KR 10-2000-0041753 A which is an application publication of KR 10-0279885 B1.
English Language Abstract of KR 10-2003-0026604 A.
English Language Abstract of KR 10-2004-0106651 A.
English Language Abstract of KR 10-2011-0032748 A.

* cited by examiner

METHOD FOR CONTROLLING HOT WATER TEMPERATURE THROUGH OPERATION OF A CIRCULATION PUMP

TECHNICAL FIELD

The present invention relates to a method for controlling hot water temperature of a water heater, and more particularly, to a control method for reducing a temperature difference of hot water that flows out from the water heater through an operation of a circulation pump.

BACKGROUND ART

FIGS. 1 and 2 are schematic diagrams of a water heater structure in the conventional art.

As shown in FIG. 1, a general water heater 1 includes an inflow pipe 10 supplying direct water to a heat exchanger, a heat exchanger 20 that causes the direct water which enters through the inflow pipe 10 to exchange heat with air or water heated by a burner to be hot water, a storage tank 30 temporarily storing the hot water generated by the heat exchanger 20, and an outflow pipe 40 through which the hot water stored in the storage tank 30 flows out.

A direct water temperature sensor 11 measuring the temperature of the direct water that enters through the inflow pipe 10 and a flow sensor 12 measuring the flow of the direct water are installed on the inflow pipe 10.

In addition, a hot water temperature sensor 41 measuring the temperature of the hot water that flows out through the outflow pipe 40 is installed on the outflow pipe 40 to supply hot water having a constant temperature to a user.

Meanwhile, the general water heater 1 may include a bypass pipe 50 connecting the outflow pipe 40 and the inflow pipe 10 to each other to supply water in the outflow pipe 40 to the inflow pipe 10. An internal circulation pump 51 supplying the water in the outflow pipe 40 to the inflow pipe 10 and a check valve 52 for preventing the water in the inflow pipe 10 from being supplied to the outflow pipe 40 without passing through the heat exchanger 20 are installed on the bypass pipe 50.

When the user does not use the hot water for a predetermined time, the temperature of the hot water stored in the storage tank 30 decreases, and as a result, the hot water stored in the storage tank 30 is sent to the heat exchanger 20 again by using the internal circulation pump 51 to be heated.

The temperature of the hot water stored in the storage tank 30 can be constantly maintained by repetitively performing the process.

Meanwhile, as shown in FIG. 2, an external circulation pipe 46 may be connected with the bypass pipe 50. Herein, the external circulation pipe 46 refers to a pipe that is branched off from around a hot water outlet 45 such as a faucet to then be connected with the bypass pipe 50.

In this case, when the hot water is circulated through the external circulation pipe 46 by operating the internal circulation pump 51, the hot water is circulated up to the vicinity of the hot water outlet 45 to preheat the outflow pipe 40, and as a result, the user can use the hot water in a short time.

However, in the water heater 1 in the conventional art, the internal circulation pump 51 is set to operate only before the user uses the hot water.

As described above, since the internal circulation pump 51 is set to operate only before the user uses the hot water, when the user temporarily stops using the hot water and thereafter, uses the hot water again, it takes a while until the hot water starts to be supplied again after supplying of the cold water and this causes inconvenience to users due to a temperature difference of the hot water.

In particular, it is more likely that the temperature difference of the hot water will occur at a hospital, a restaurant, and a health club where the hot water is frequently used and the flow rate of the used hot water frequently varies.

DISCLOSURE

Technical Problem

The present invention is contrived to solve the problems and provides a method for controlling the temperature of hot water that can reduce a temperature difference which occurs when a user uses hot water through an operation of a circulation pump.

Technical Solution

A method for controlling the temperature of hot water through an operation of a circulation pump according to an embodiment of the present invention includes: judging whether a user uses the hot water; judging whether one of the circulation pump operating modes is selected; and circulating the hot water in an outflow pipe to an inflow pipe by operating the circulation pump provided on a bypass pipe connecting the inflow pipe into which direct water flows and the outflow pipe through which heated hot water flows out to each other when the user uses the hot water and selects one of the circulation pump operating modes.

Further, the circulation pump operating modes include a continuous circulation pump operating mode in which when the user uses the hot water, the circulation pump is continuously operated until the user stops using the hot water.

In addition, the circulation pump operating modes include a stop after operating the circulation pump mode comprising judging whether the flow of used hot water is equal to or larger than a predetermined value and turning off the circulation pump when the flow of the used hot water is equal to or larger than the predetermined value.

Moreover, the stop after operating the circulation pump mode further includes judging whether a predetermined time has elapsed after starting using the hot water before judging whether the flow of the used hot water is equal to or larger than the predetermined value.

Besides, the circulation pump operating modes include a stop and restart after operating the circulation pump mode comprising judging whether the flow of the used hot water is reduced by the predetermined value or more in a state where the circulation pump is turned off and turning on the circulation pump when the flow of the used hot water is reduced by the predetermined value or more.

In addition, the stop and restart after operating the circulation pump mode further includes judging whether the flow of the used hot water is equal to or larger than the predetermined value and turning off the circulation pump when the flow of the used hot water is equal to or larger than the predetermined value.

Moreover, the stop and restart after operating the circulation pump mode further includes judging whether the predetermined time has elapsed after starting using the hot water.

Advantageous Effects

According to a method for controlling the temperature of hot water through an operation of a circulation pump according to an embodiment of the present invention, since the circulation pump operates even while a user uses the hot water, a temperature difference of the hot water can be reduced even when the flow of used hot water varies.

| Reference Numbers | |
|---|---|
| 1: Water heater | 10: Inflow pipe |
| 11: Direct water temperature sensor | 12: Flow sensor |
| 20: Heat exchanger | 30: Storage tank |
| 40: Outflow pipe | 41: Hot water temperature sensor |
| 45: Hot water outlet | 46: External circulation pipe |
| 50, 60: Bypass pipe | 51: Internal circulation pipe |
| 52, 62: Check valve | 61: External circulation pump |

BEST MODE

Hereinafter, a method for controlling the temperature of hot water through an operation of a circulation pump according to an embodiment of the present invention will be described in detail with reference to the accompanying drawings.

Figure 1:
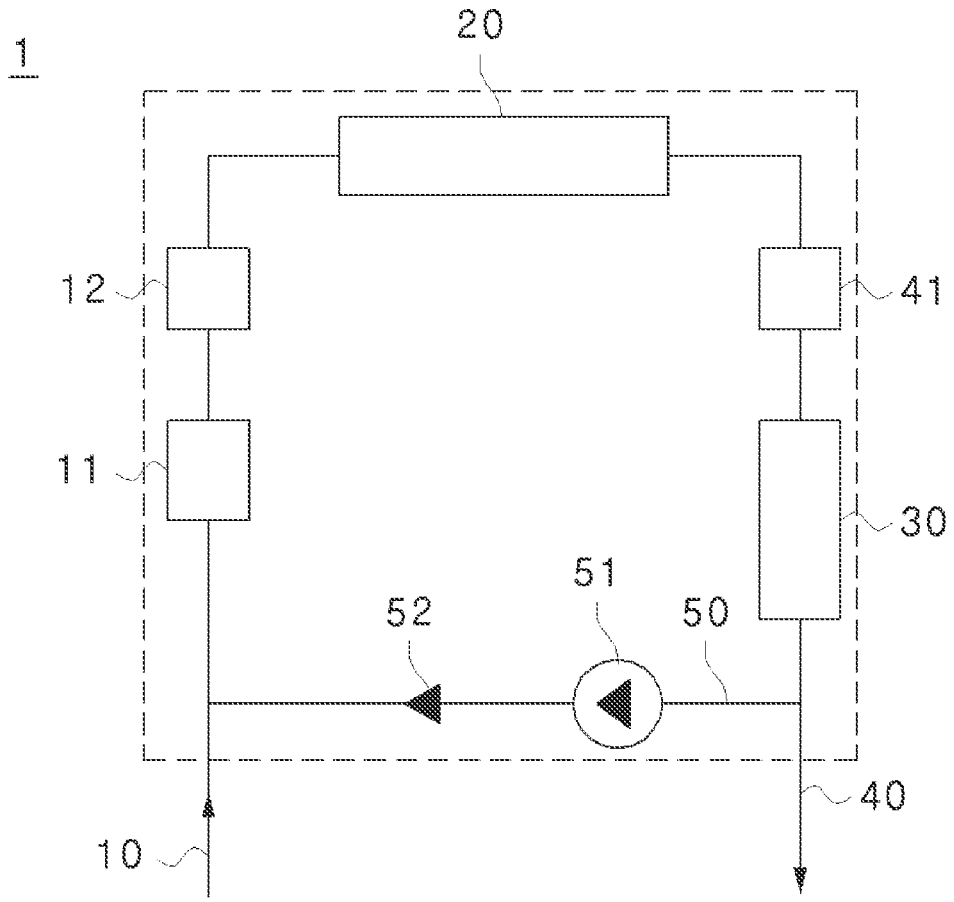
FIG. 1 PRIOR ART
FIGS. 1 and 2 are schematic diagrams of a structure of a water heater in the conventional art.
Figure 2:
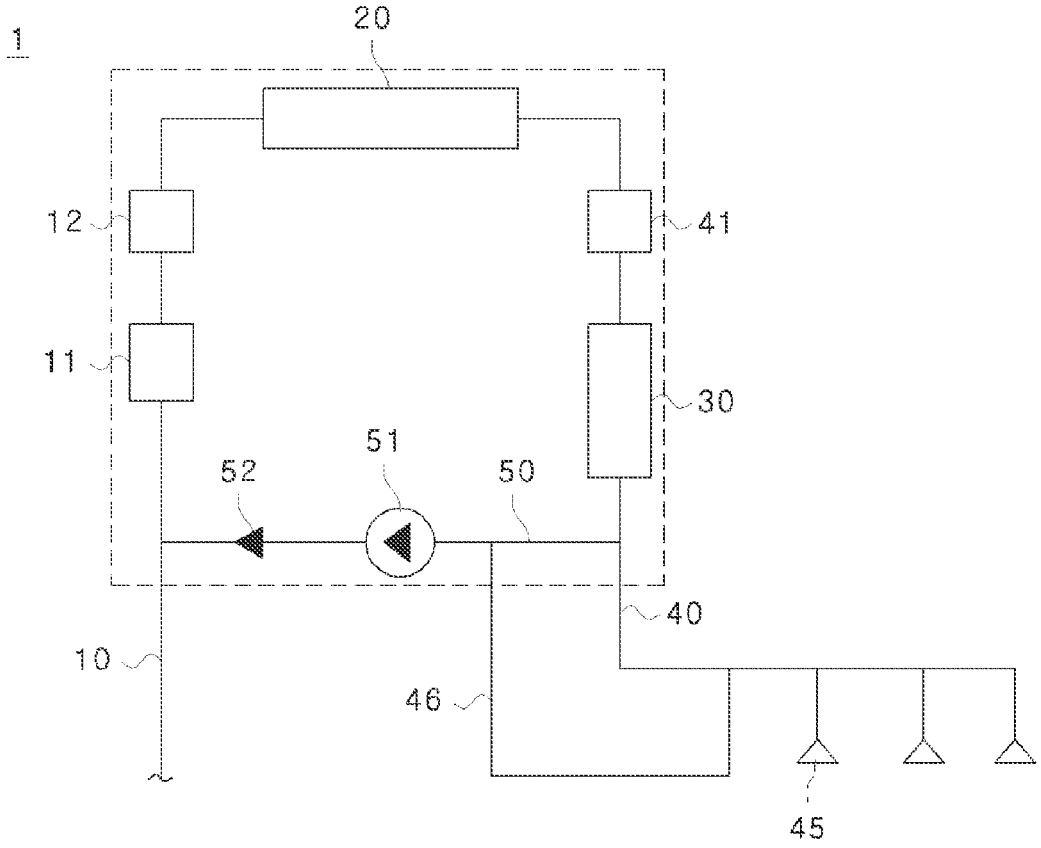
FIG. 2 PRIOR ART

The method for controlling the temperature of hot water through the operation of a circulation pump according to the embodiment of the present invention may be executed in a water heater shown in FIGS. 1 and 2.

Figure 3:
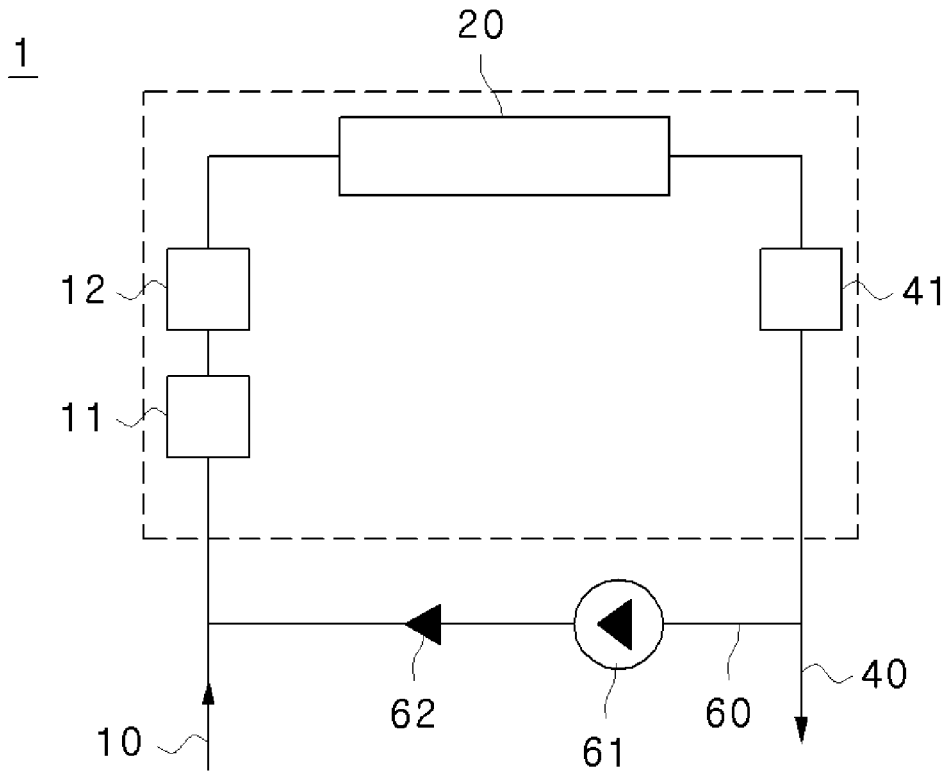
FIG. 3 is a diagram showing a state in which a bypass pipe connecting an outflow pipe and an inflow pipe to each other is installed outside of a water heater and an external circulation pump is installed on the bypass pipe when no circulation pump is installed in the water heater.

Alternatively, as shown in FIG. 3, when no circulation pump is installed in the water heater 1, a bypass pipe 60 connecting an outflow pipe 40 and an inflow pipe 10 to each other is installed outside of the water heater and an external circulation pump 61 and an external check valve 62 are installed on the bypass pipe 60 to execute the method for controlling the temperature of hot water through the operation of a circulation pump according to the embodiment of the present invention.

Figure 4:
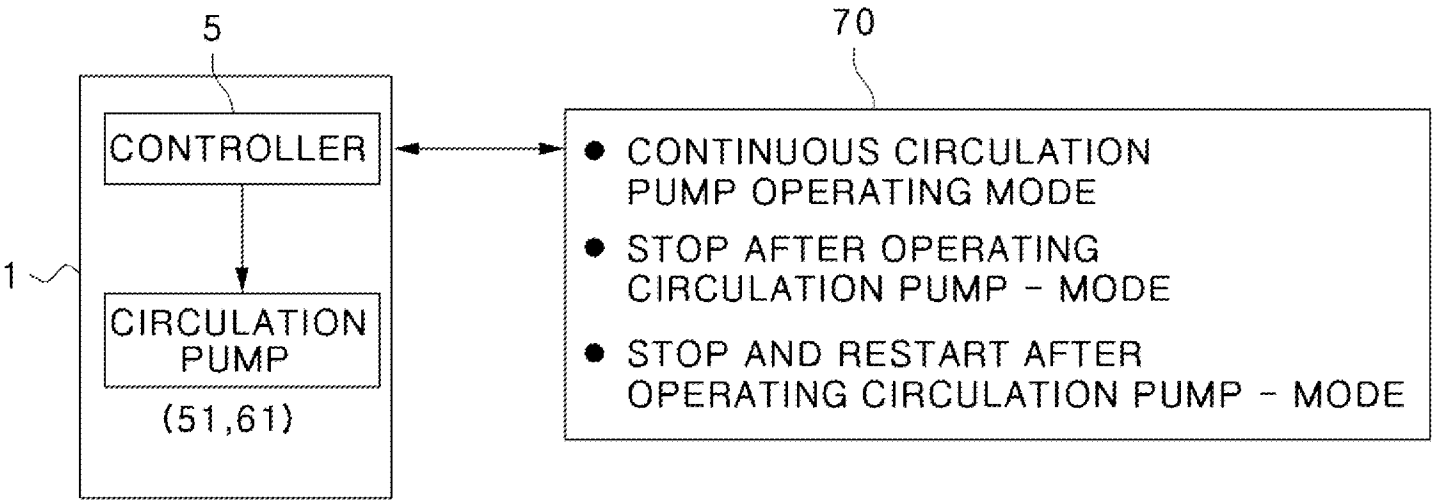
FIG. 4 is a block diagram illustrating the relationship between a hot water temperature setting unit for a user to set the temperature of hot water and a water heater.

FIG. 4 is a block diagram illustrating the relationship between a hot water temperature setting unit 70 for a user to set the temperature of the hot water and the water heater 1.

As shown in FIG. 4, various circulation pump operating modes for the user to control the temperature of the hot water by using the circulation pumps 51 and 61 are included in the hot water temperature setting unit 70 and the user may select one of the various circulation pump operating modes.

When the user selects one of the modes of using the circulation pumps 51 and 61 in the hot water temperature setting unit 70, a signal indicating that the user selected one of the modes of using the circulation pumps 51 and 61 is transmitted to a controller 5 in the water heater 1 through communication and the controller 5 controls the circulation pumps 51 and 61 to control the temperature of hot water that flows out from the water heater 1.

In the embodiment, although it is assumed that a temperature controller has three modes, that is, a continuous circulation pump operating mode, a stop after operating the circulation pumps mode, and a stop and restart after operating the circulation pumps mode in which the circulation pumps can be operated, other modes may be set for operating the circulation pumps, in addition to those three modes.

Hereinafter, a method for controlling the temperature of hot water through the operation of a circulation pump according to an embodiment of the present invention will be described.

Figure 5:
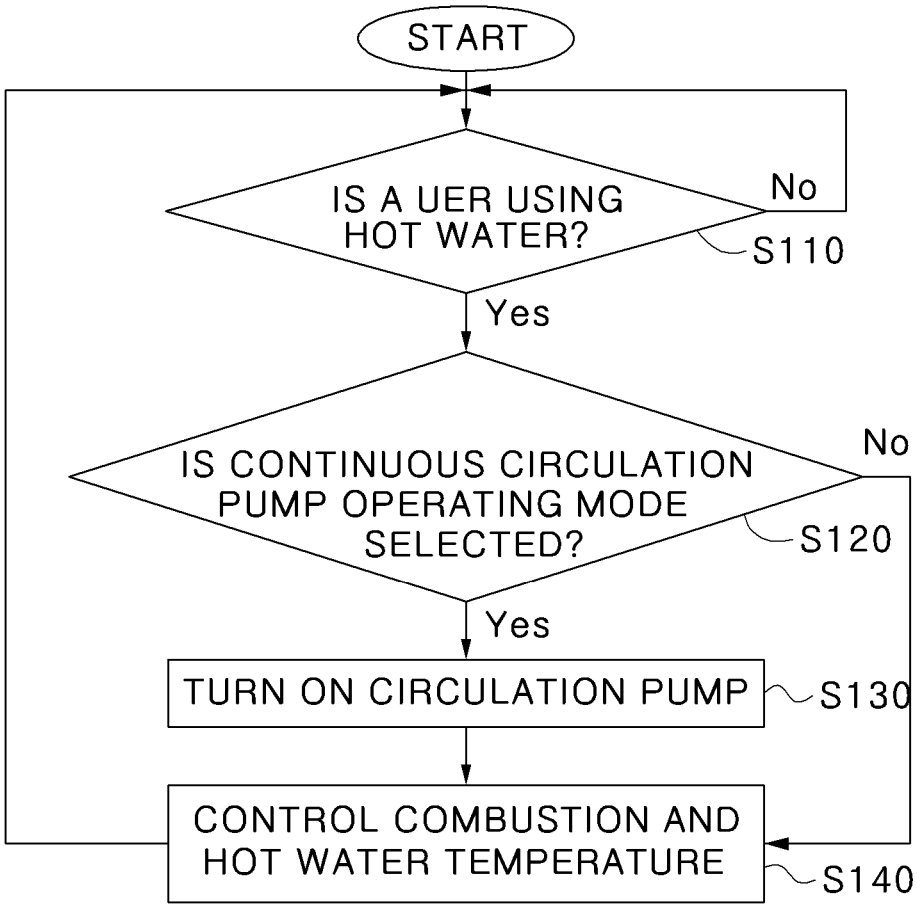
FIG. 5 is a flowchart illustrating a method for controlling the temperature of hot water in a continuous circulation pump operation mode.

First, referring to a flowchart shown in FIG. 5, the method for controlling the temperature of hot water will be described in the continuous circulation pump operating mode.

A controller 5 judges whether a user uses the hot water (S110) and judges whether the user selects the continuous circulation pump operating mode (S120).

If it is judged that the user uses the hot water and selects the continuous circulation pump operating mode, circulation pumps 51 and 61 are turned on (S130) and combustion and a hot water temperature of a water heater are controlled (S140)

When the user uses the hot water in the continuous circulation pump operating mode, the circulation pumps 51 and 61 are continuously operated until the user stops using the hot water. Therefore, some of the hot water in the outflow pipe 40 flows into the inflow pipe 10 through bypass pipes 50 and 60 to be mixed with the direct water and the temperature of the mixed water becomes higher than the temperature of the direct water and thereafter, is heated by a heat exchanger 20, and as a result, the temperature difference of the hot water that flows out from the outflow pipe 40 can be reduced.

However, operating time of the circulation pumps 51 and 61 is increased, accordingly, electricity consumption also increases.

Figure 6:
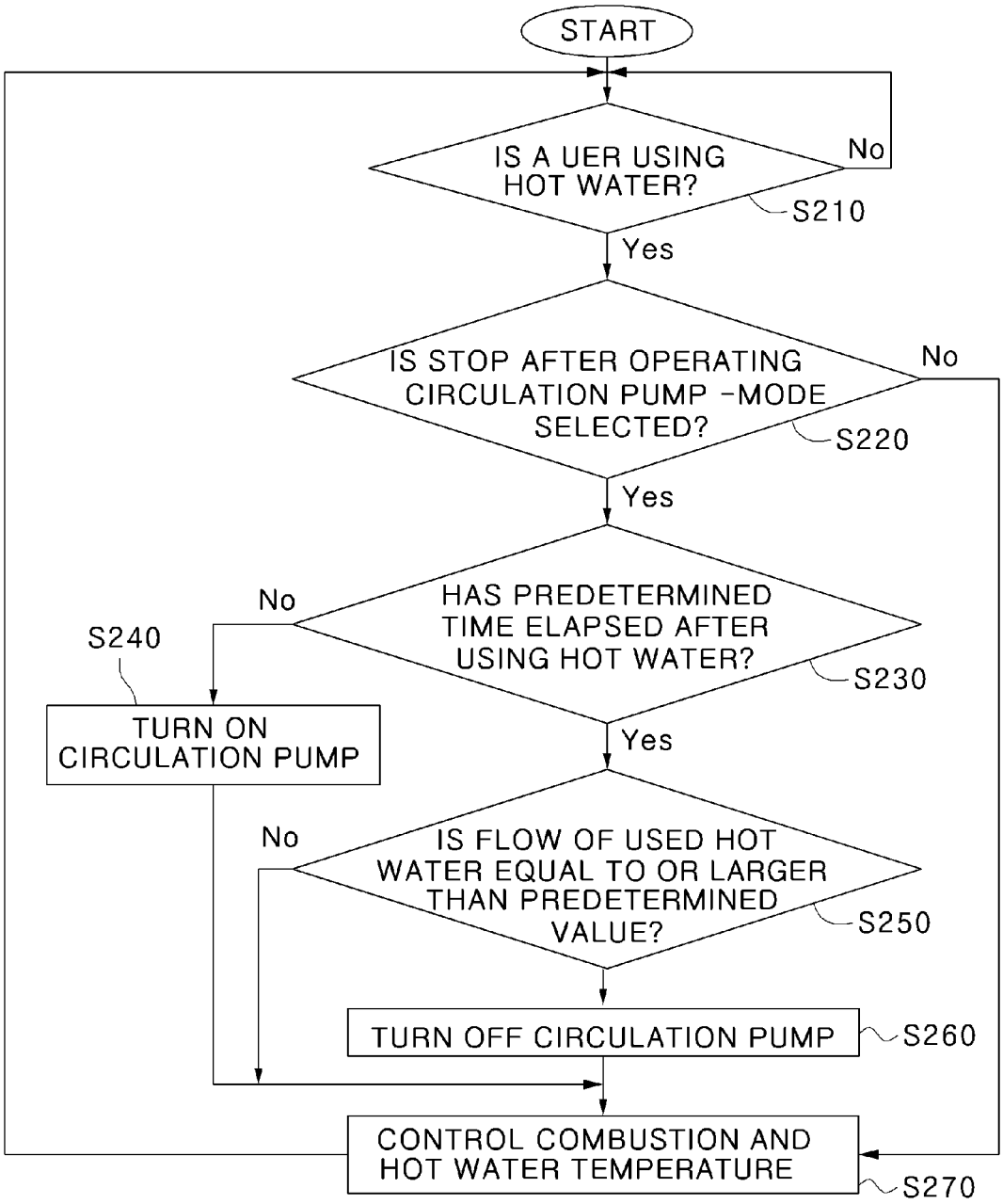
FIG. 6 is a flowchart illustrating the method for controlling the temperature of hot water in a stop after the circulation pump mode operates.

Next, referring to a flowchart shown in FIG. 6, the method for controlling the temperature of hot water will be described in the stop after operating the circulation pumps mode.

The controller 5 judges whether the user uses the hot water (S210) and judges whether the user selects the stop after operating the circulation pumps mode (S220).

If it is judged that the user uses the hot water and selects the stop after operating the circulation pumps mode, it is judged whether a predetermined time has elapsed after starting using the hot water (S230).

After starting using the hot water, if the preset time does not have elapsed, the circulation pumps 51 and 61 are continuously maintained to be ON (S240) and if the predetermined time has elapsed, it is judged whether the flow of the used hot water is equal to or larger than a predetermined value (S250). If the flow of the used hot water is equal to larger than the predetermined value, the circulation pumps 51 and 61 are turned off (S260). The reason therefore is that the effect of reducing the temperature difference of the hot water due to the use of the circulation pumps 51 and 61 is lessened because the flow circulated through the circulation pumps 51 and 61 is decreased when the flow of the used hot water is equal to or larger than the predetermined value.

Next, the combustion and hot water temperature of the water heater are controlled (S270).

The temperature difference of the hot water can be reduced and the electricity consumption can be reduced at an initial stage when the user uses the hot water in the stop after operating the circulation pumps mode.

Figure 7:
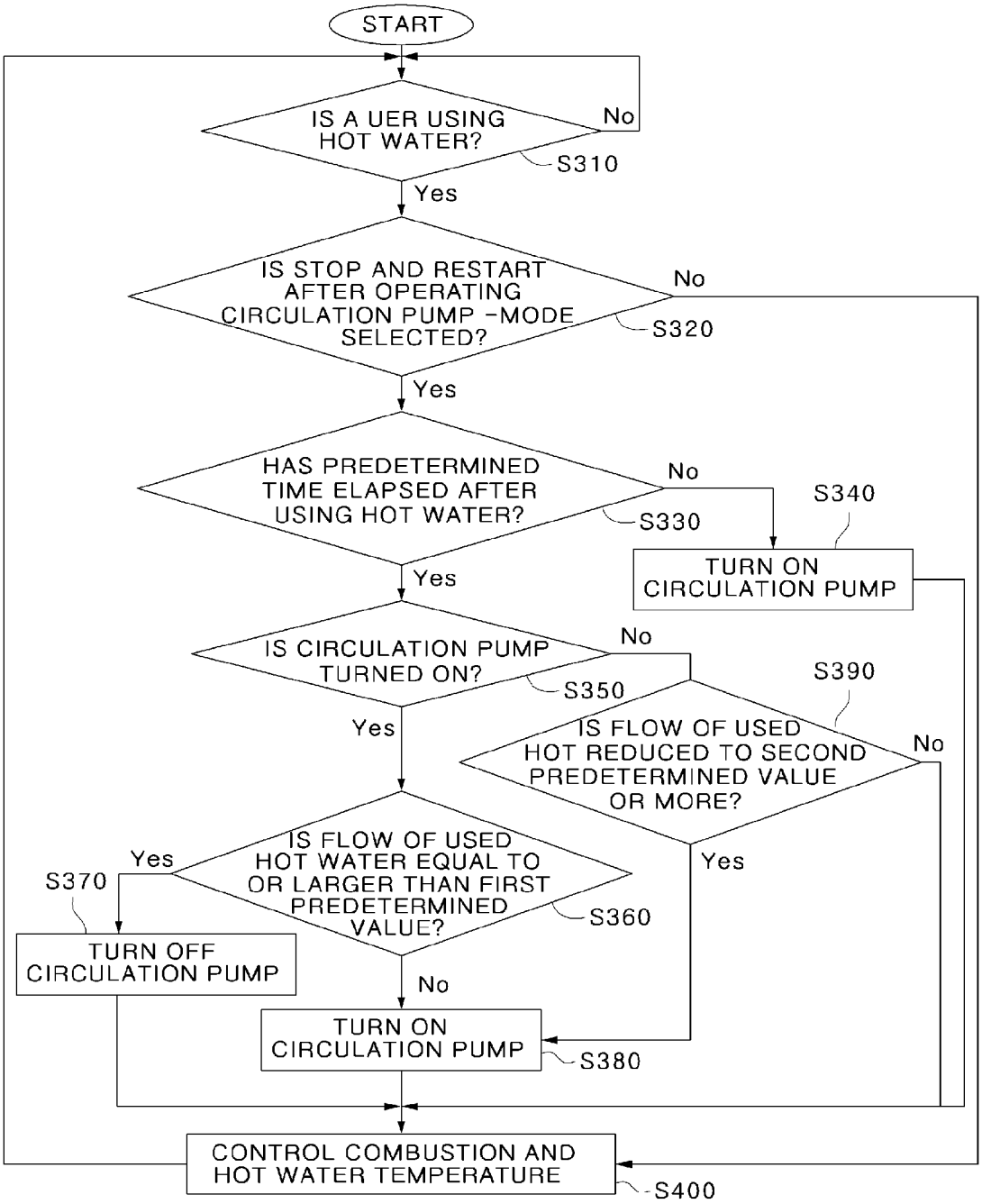
FIG. 7 is a flowchart illustrating the method for controlling the temperature of hot water in a stop and restart after the circulation pump mode operates.

Next, referring to a flowchart shown in FIG. 7, the method for controlling the temperature of hot water will be described in the stop and restart after operating the circulation pumps mode.

The controller 5 judges whether the user uses the hot water (S310) and judges whether the user selects the stop and restart after operating the circulation pumps mode (S320).

If it is judged that the user uses the hot water and selects the stop and restart after operating the circulation pumps mode, it is judged whether a predetermined time has elapsed after starting using the hot water (S330).

After starting using the hot water, if the predetermined time does not have elapsed, the circulation pumps 51 and 61 are maintained to be ON (S340) and if the predetermined time has elapsed, it is judged whether the circulation pumps 51 and 61 are ON (S350).

In this step, if the circulation pumps 51 and 61 are ON, it is judged whether the flow of the used hot water is equal to or larger than a first predetermined value (S360). In this case, if the flow of the used hot water is equal to larger than the first predetermined value, the circulation pumps 51 and 61 are turned off (S370) and if the flow of the used hot water is not equal to or larger than the first predetermined value, the circulation pumps 51 and 61 are continuously turned on (S380). Thereafter, the combustion and hot water temperature are controlled (S400).

If the predetermined time has elapsed after using the hot water, but the circulation pumps 51 and 61 are not ON, it is judged whether the flow of the used hot water is reduced by a second predetermined value or more (S390).

In this case, if the flow of the used hot water is reduced by the second predetermined value or more, the circulation pumps 51 and 61 are turned on (S380) and if the flow of the used hot water is not reduced by the second predetermined value or more, the combustion and the hot water temperature are controlled (S400).

The temperature difference of the hot water can be reduced at the initial stage when the user uses the hot water in the stop and restart after operating the circulation pumps mode, and if the flow of the used hot water is equal to or larger than the predetermined value, the circulation pumps are turned off and if the flow of the used hot water is reduced by the predetermined value or more, the circulation pumps are turned on, and as a result, the temperature difference of the hot water can be reduced when the flow varies.

As described above, according to the method for controlling the temperature of hot water through operation of a circulation pump according to the embodiment of the present invention, even when the flow of the used hot water varies, the temperature difference of the hot water can be reduced.

What is claimed is:

1. A method for controlling a temperature of hot water through operation of a circulation pump, comprising an inflow pipe through which direct water enters, an outflow pipe through which heated hot water flows out, and a bypass pipe connecting the inflow pipe and the outflow pipe, wherein some of the hot water in the outflow pipe flows into the inflow pipe according to the operation of the circulation pump, comprising of judging whether a user uses the hot water;

judging whether one of circulation pump operating modes is selected;

wherein if STOP after operating the circulation pump mode is selected when the user uses the hot water, judging whether a flow of used hot water is equal to or larger than a predetermined value; and operating the circulation pump if the flow of the used hot water is equal to or lower than the predetermined value, and turning to OFF for the circulation pump if the flow of the used hot water is equal to or larger than the predetermined value.

2. The method for controlling the temperature of the hot water through the operation of the circulation pump according to claim 1, wherein the circulation pump operating modes further comprise a continuous circulation pump operating mode, wherein, if the continuous circulation pump operating mode is selected when the user uses the hot water, the circulation pump is continuously operated until the user stops using the hot water.

3. The method for controlling the temperature of the hot water through the operation of the circulation pump according to claim 1, wherein, if STOP after operating the circulation pump mode is selected, the method further comprises a step of judging whether the predetermined time has elapsed after using the hot water before judging whether the flow of the used hot water is equal to or larger than the predetermined value, wherein, if the predetermined time has not elapsed after using the hot water, operating the circulation pump without judging whether the flow of the used hot water is equal to or larger than the predetermined value, and if the predetermined time has elapsed after using the hot water, judging whether the flow of the used hot water is equal to or larger than the predetermined value.

4. The method for controlling the temperature of the hot water through the operation of the circulation pump according to claim 1, wherein the circulation pump operating modes further comprise a stop and restart after operating the circulation pump mode, and if stop and restart after operating the circulation pump mode is selected when the user uses the hot water, the method further comprises:

judging whether the circulation pump is turned ON and turning OFF the circulation pump if the circulation pump is ON and the flow of the used hot water is equal to or larger than a first predetermined value, and turning ON the circulation pump if the circulation pump is OFF and the flow of the used hot water is reduced by a second predetermined value or more.

5. The method for controlling the temperature of the hot water through the operation of the circulation pump according to claim 4, wherein if stop and restart after operating the circulation pump mode is selected when the user uses the hot water, the method further comprises judging whether the predetermined time has elapsed after using the hot water before judging whether the circulation pump is turned ON, wherein if the predetermined time has not elapsed after using the hot water, the circulation pump is operated without judging whether the the circulation pump is turned ON, and if the predetermined time has elapsed after using the hot water, judging whether the circulation pump is turned ON.

* * * * *